US011730331B2

(12) United States Patent
Verhasselt

(10) Patent No.: US 11,730,331 B2
(45) Date of Patent: Aug. 22, 2023

(54) SWEEPER/SCRUBBER SYSTEM CAPABLE OF HANDLING LARGE DEBRIS

(71) Applicant: Tennant Company, Minneapolis, MN (US)

(72) Inventor: Andrew R. Verhasselt, Hopkins, MN (US)

(73) Assignee: Tennant Company, Minneapolis, MN (US)

( * ) Notice: Subject to any disclaimer, the term of this patent is extended or adjusted under 35 U.S.C. 154(b) by 603 days.

(21) Appl. No.: 16/722,965

(22) Filed: Dec. 20, 2019

(65) Prior Publication Data

US 2020/0196818 A1 Jun. 25, 2020

Related U.S. Application Data

(60) Provisional application No. 62/783,451, filed on Dec. 21, 2018.

(51) Int. Cl.

| | |
|---|---|
| ***A47L 11/30*** | (2006.01) |
| ***A47L 11/24*** | (2006.01) |
| ***A47L 11/40*** | (2006.01) |

(52) U.S. Cl.

CPC ..... *A47L 11/302* (2013.01); *A47L 11/24* (2013.01); *A47L 11/4016* (2013.01);

(Continued)

(58) Field of Classification Search

None

See application file for complete search history.

(56) References Cited

U.S. PATENT DOCUMENTS

| | | | |
|---|---|---|---|
| 3,013,288 | A | 12/1961 | Lappin |
| 3,024,484 | A | 3/1962 | Wallace |

(Continued)

FOREIGN PATENT DOCUMENTS

| | | | |
|---|---|---|---|
| CA | 2753157 | A1 | 4/2010 |
| CN | 201094599 | Y | 8/2008 |

(Continued)

OTHER PUBLICATIONS

"Kärcher FC 3 Cordless Animation—Funktion," Kärcher Center Müller, Retrieved online from <https://www.youtube.com/watch?v=Bmp8YktyRsc>, Published Oct. 4, 2018.

(Continued)

*Primary Examiner* — Natasha N Campbell
*Assistant Examiner* — Pradhuman Parihar
(74) *Attorney, Agent, or Firm* — Fredrikson & Byron, P.A.

(57) ABSTRACT

A sweeper/scrubber assembly may be used to clean a floor surface without dry sweeping or mopping solid debris from the floor surface before conveying the sweeper/scrubber assembly over the floor surface. In some examples, the sweeper/scrubber assembly includes at least two counter-rotating brushes, a cleaning fluid dispensing system, a vacuum squeegee, and a solid debris collection reservoir. The cleaning fluid dispensing system can dispense cleaning fluid on the floor being cleaning and or one or both brushes. The vacuum squeegee can be positioned against a face of one of the brushes and can apply a vacuum suction force to the face of the brush. The solid debris collection reservoir can be a space not exposed to a vacuum force that collects solid debris thrown by the rotating brushes.

20 Claims, 10 Drawing Sheets

(52) U.S. Cl.
CPC ..... *A47L 11/4041* (2013.01); *A47L 11/4044* (2013.01); *A47L 11/4069* (2013.01); *A47L 11/4083* (2013.01); *A47L 11/4088* (2013.01)

(56) References Cited

U.S. PATENT DOCUMENTS

| | | | |
|---|---|---|---|
| 3,258,803 | A | 7/1966 | Wolter et al. |
| 3,451,087 | A | 6/1969 | Jepson et al. |
| 3,518,712 | A | 7/1970 | Berger |
| 5,353,471 | A | 10/1994 | Guehne et al. |
| 5,515,568 | A | 5/1996 | Larson et al. |
| 5,611,106 | A | 3/1997 | Wulff |
| 6,421,869 | B1 | 7/2002 | Olsson |
| 6,571,423 | B1 | 6/2003 | Lijzenga et al. |
| 6,934,993 | B1 | 8/2005 | Huffman et al. |
| 6,964,081 | B1 | 11/2005 | Clement et al. |
| 6,990,709 | B2 | 1/2006 | Fields |
| 7,063,474 | B2 | 6/2006 | DeFields et al. |
| 7,337,490 | B2 | 3/2008 | Goff |
| 7,448,114 | B2 | 11/2008 | Basham et al. |
| 7,475,450 | B1 | 1/2009 | Ragner |
| 7,758,702 | B1 | 7/2010 | Huffman |
| 7,805,802 | B2 | 10/2010 | Shinler et al. |
| 7,819,127 | B1 | 10/2010 | Huffman |
| 7,904,990 | B1 | 3/2011 | Miner |
| 7,967,914 | B2 | 6/2011 | Giddings et al. |
| 8,719,998 | B1 | 5/2014 | Huffman |
| 8,726,441 | B1 | 5/2014 | Colasanti et al. |
| D781,014 | S | 3/2017 | Wu et al. |
| 9,649,002 | B1 | 5/2017 | Pollack et al. |
| 9,924,844 | B1 * | 3/2018 | Person ..... A47L 11/28 |
| 2001/0047562 | A1 | 12/2001 | Lenkiewicz et al. |
| 2002/0026683 | A1 | 3/2002 | Kasper et al. |
| 2002/0083548 | A1 | 7/2002 | Hansen |
| 2002/0194692 | A1 * | 12/2002 | Giddings ..... A47L 11/4069 15/322 |
| 2003/0088939 | A1 | 5/2003 | Miner |
| 2005/0115098 | A1 | 6/2005 | Rust et al. |
| 2005/0223516 | A1 | 10/2005 | Courtney |
| 2006/0150352 | A1 * | 7/2006 | Field ..... A47L 11/4013 15/230.14 |
| 2006/0179604 | A1 | 8/2006 | Boddy et al. |
| 2006/0236494 | A1 | 10/2006 | Nelson et al. |
| 2007/0089260 | A1 | 4/2007 | Shinler et al. |
| 2007/0209138 | A1 | 9/2007 | Tran et al. |
| 2007/0226946 | A1 | 10/2007 | Best |
| 2008/0047092 | A1 | 2/2008 | Schnittman et al. |
| 2008/0092325 | A1 | 4/2008 | Vander Baan |
| 2008/0172818 | A1 | 7/2008 | Yoo |
| 2008/0196193 | A1 | 8/2008 | Huffman et al. |
| 2009/0229069 | A1 | 9/2009 | Lenkiewicz et al. |
| 2010/0050367 | A1 | 3/2010 | Tsai |
| 2010/0205768 | A1 | 8/2010 | Oh |
| 2010/0287716 | A1 | 11/2010 | Kasper et al. |
| 2011/0079248 | A1 | 4/2011 | Huffman et al. |
| 2011/0132406 | A1 | 6/2011 | Huffman et al. |
| 2011/0146009 | A1 | 6/2011 | Marsh et al. |
| 2011/0180105 | A1 | 7/2011 | Moes |
| 2011/0191968 | A1 | 8/2011 | Moes et al. |
| 2012/0096671 | A1 | 4/2012 | Venard et al. |
| 2012/0110775 | A1 | 5/2012 | Krebs |
| 2012/0115401 | A1 | 5/2012 | Lombard et al. |
| 2012/0144621 | A1 | 6/2012 | Forbes et al. |
| 2012/0222234 | A1 | 9/2012 | DeJonge |
| 2012/0222235 | A1 | 9/2012 | Lenkiewicz et al. |
| 2012/0284950 | A1 | 11/2012 | De Wit et al. |
| 2013/0025077 | A1 | 1/2013 | De Wit et al. |
| 2013/0174373 | A1 | 7/2013 | Genn et al. |
| 2013/0205539 | A1 | 8/2013 | Dyson et al. |
| 2013/0212832 | A1 | 8/2013 | Genn et al. |
| 2013/0232713 | A1 | 9/2013 | Luedke et al. |
| 2013/0305468 | A1 | 11/2013 | De Wit et al. |
| 2013/0318740 | A1 | 12/2013 | DeJonge et al. |
| 2014/0041153 | A1 | 2/2014 | De Wit et al. |
| 2014/0150191 | A1 | 6/2014 | De Wit et al. |
| 2014/0165324 | A1 | 6/2014 | Luo et al. |
| 2014/0173847 | A1 | 6/2014 | Nguyen |
| 2014/0182079 | A1 | 7/2014 | Van Der Kooi et al. |
| 2014/0196230 | A1 | 7/2014 | Pyne et al. |
| 2014/0196247 | A1 | 7/2014 | Kasper |
| 2014/0215749 | A1 | 8/2014 | Van Der Kooi et al. |
| 2014/0245560 | A1 | 9/2014 | Huang et al. |
| 2014/0359965 | A1 | 12/2014 | Hansen et al. |
| 2015/0113757 | A1 | 4/2015 | Franke et al. |
| 2015/0250367 | A1 | 9/2015 | Van Der Kooi et al. |
| 2015/0289735 | A1 | 10/2015 | Van Der Kooi et al. |
| 2015/0297047 | A1 | 10/2015 | Van Der Kooi et al. |
| 2015/0327743 | A1 | 11/2015 | Van Der Kooi et al. |
| 2016/0174792 | A1 | 6/2016 | Williamson et al. |
| 2016/0256025 | A1 | 9/2016 | Van Der Kooi et al. |
| 2016/0278597 | A1 | 9/2016 | Braendle et al. |
| 2016/0309973 | A1 * | 10/2016 | Sheikh ..... A47L 11/4044 |
| 2016/0367093 | A1 | 12/2016 | VanTongeren |
| 2017/0027401 | A1 | 2/2017 | Windmeisser et al. |
| 2017/0071434 | A1 | 3/2017 | Nguyen et al. |
| 2017/0119225 | A1 | 5/2017 | Xia et al. |
| 2017/0215676 | A1 | 8/2017 | Moser et al. |
| 2018/0263453 | A1 | 9/2018 | Braendle et al. |
| 2019/0000292 | A1 | 1/2019 | Rufenach et al. |

FOREIGN PATENT DOCUMENTS

| | | | |
|---|---|---|---|
| CN | 204146956 | U | 2/2015 |
| CN | 104644062 | A | 5/2015 |
| CN | 205391068 | U | 7/2016 |
| CN | 303806066 | S | 8/2016 |
| CN | 106175613 | A | 12/2016 |
| CN | 207270314 | U | 4/2018 |
| CN | 109008838 | A | 12/2018 |
| DE | 202016105299 | U1 | 10/2016 |
| EP | 1479336 | A2 | 11/2004 |
| EP | 3117755 | A1 | 1/2017 |
| GB | 2551073 | A | 12/2017 |
| GB | 2551938 | A | 1/2018 |
| WO | 9014787 | A1 | 12/1990 |
| WO | 0006011 | A2 | 2/2000 |
| WO | 2009149722 | A1 | 12/2009 |
| WO | 2010041184 | A1 | 4/2010 |
| WO | 2016062647 | A1 | 4/2016 |
| WO | 2017071727 | A1 | 5/2017 |

OTHER PUBLICATIONS

"SC100 Upright Scrubber," Nilfisk, Retrieved online from <https://new.nilfisk.com/en-us/products/floor-cleaning/scrubbers/walk-behind-scrubber-and-dryers/small/p_107408120/> on Feb. 14, 2020, 5 pages.
"SC250 Walk-Behind Floor Scrubbers," Nilfisk, Retrieved online from <https://new.nilfisk.com/en-us/products/floor-cleaning/scrubbers/walk-behind-scrubber-and-dryers/small/p_9087381020/> on Feb. 14, 2020, 6 pages.
"Brush CYL 310mm Microfibre," Nilfisk, Retrieved online from <https://www.nilfisk.com/en-gb/products/Pages/product.aspx?pid=107411862#opentab-tab-ProductInfo> on Feb. 14, 2020, 2 pages.
"BR 30/4 C," Alfred Kärcher SE & Co. KG, Retrieved online from <https://www.kaercher.com/int/professional/floor-scrubbers-scrubber-driers/compact-push-scrubber-driers/br-30-4-c-17832200.html> on Feb. 14, 2020, 9 pages.
"BR 35/12 C Bp Pack," Alfred Kärcher SE & Co. KG, Retrieved online from <https://www.kaercher.com/int/professional/floor-scrubbers-scrubber-driers/compact-push-scrubber-driers/br-35-12-c-bp-pack-17834500.html> on Feb. 14, 2020, 15 pages.
"Microfibre roller, 300 mm," Alfred Kärcher SE & Co. KG, Retrieved online from <https://www.kaercher.com/int/accessory/microfibre-roller-300-mm-47624530.html> on Feb. 14, 2020, 3 pages.
"Chariot 2 iVac 24 ATV," Windsor Kärcher Group, Retrieved online from <https://www.windsorkarchergroup.com/en/products/vacuums/stand-on-vacuums/chariot-2-ivac-24-atv-10125760.html> on Feb. 14, 2020, 4 pages.
"M20 Ride-On Sweeper-Scrubber," Tennant Company, Retrieved online from <https://www.tennantco.com/en_us/1/machines/sweeper-

(56) References Cited

OTHER PUBLICATIONS scrubbers/product.m20.integrated-rider-sweeper-scrubber.M-M20.html> on Feb. 14, 2020, 15 pages.
"DP340," NaceCare Solutions, Retrieved online from <http://www.nacecare.com/products/dp340> on Feb. 14, 2020, 2 pages.
"DP 340 Nacecare Duplex 11" Multi Surface Cleaner Scrubber, S&Y Trading Corp, Retrieved online from <https://www.sandytrading.com/AUTO-SCRUBBERS/DP-340-Nacecare-Duplex-11-Multi-Surface-Cleaner-Scrubber_450.aspx> on Feb. 14, 2020, 9 pages.
"R3 Compact Carpet Extractor," Tennant Company, Retrieved online from <https://www.tennantco.com/en_us/1/machines/extractors/product.r3.compact-rapid-drying-carpet-extractor.9004192.html> on Feb. 14, 2020, 13 pages.
"Bissell® CrossWave® All-in-One Multi-Surface Wet Dry Vac | 1785A," Bissell, Retrieved online from <https://www.bissell.com/bissell-crosswave-all-in-one-multi-surface-wet-dry-vac-1785a> on Feb. 14, 2020, 13 pages.
"AquaTrio Pro Vacuum—All in One Hard Floor Cleaner," Philips, Retrieved online from <https://www.philips.com.au/c-m-ho/vacuum-cleaners/aquatrio-pro> on Feb. 14, 2020, 7 pages.
"Walk-behind compact floor scrubber BR 30/4 C," Karcher North America, Retrieved online from <https://www.kaercher.com/us/professional/floor-scrubbers/walk-behind-compact-floor-scrubbers/br-30-4-c-17832210.html> on Feb. 14, 2020, 11 pages.
"MotoMop," Betco, Retrieved online from <https://www.betco.com/products/motomop/e84700> on Feb. 14, 2020, 1 page.
"Dyson V8™ cordless stick vacuum cleaners," Dyson, Retrieved online from <https://www.dyson.com/sticks/dyson-v8-overview.html> on Feb. 14, 2020, 8 pages.
"i-mop floor scrubber," i-teamglobal, Retrieved online from <https://www.i-teamglobal.com/Products/i-mop#i-mop> on Feb. 14, 2020, 6 pages.
Fimap Scrubbing Machines, Retrieved online from <https://www.fimap.com/> on Feb. 14, 2020, 5 pages.
"FC 5 Premium," Karcher North America, Retrieved online from <https://www.kaercher.com/us/home-garden/hard-floor-cleaner/fc-5-premium-10554630.html> on Feb. 14, 2020, 18 pages.
International Patent Application No. PCT/US2019/067913, International Search Report and Written Opinion dated Feb. 27, 2020, 12 pages.

* cited by examiner

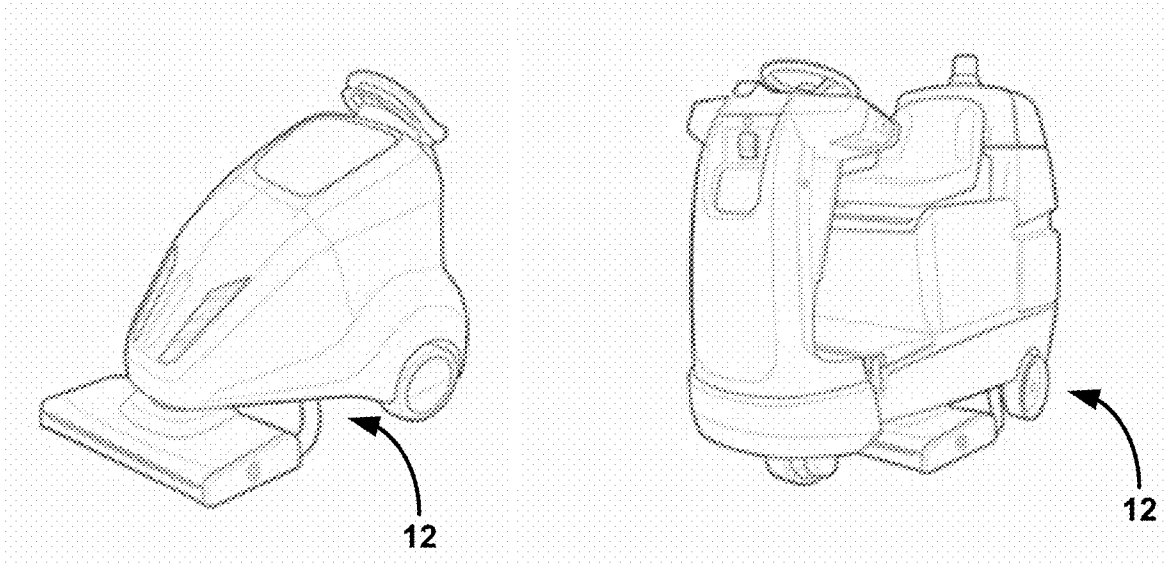
FIG. 7C
FIG. 7B
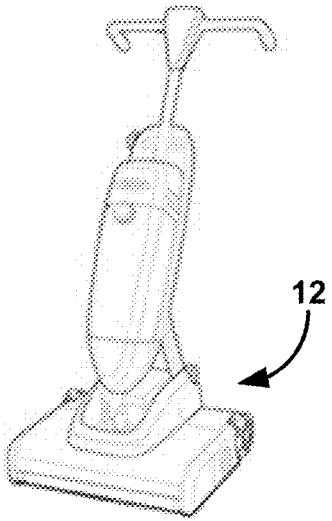
FIG. 7A

SWEEPER/SCRUBBER SYSTEM CAPABLE OF HANDLING LARGE DEBRIS

This application claims the benefit of U.S. Provisional Patent Application No. 62/783,451, filed Dec. 21, 2018, the entire contents of which are incorporated herein by reference.

TECHNICAL FIELD

This disclosure relates to cleaning systems and techniques, particularly for cleaning floor surfaces.

BACKGROUND

Floor cleaning in public, commercial, institutional, and industrial buildings have led to the development of various specialized floor cleaning machines, such as hard and soft floor cleaning machines. Representative hard floor surfaces include tile, concrete, laminate (e.g., Formica®), natural and artificial wood, and the like. A representative soft floor surface is carpet. These cleaning machines generally utilize a cleaning head that includes one or more cleaning tools configured to perform the desired cleaning operation. An operator typically utilizes multiple different cleaning machines and implements to clean the different floor surfaces present in building being cleaned.

For example, a typical commercial cleaning process may involve an operator dry mopping a floor surface using a broom or dust mop to pick up large debris spilled on the floor. After handling the large debris collection, the operator may run a hard surface scrubber over the floor. The scrubber may dispense a liquid cleaning fluid on the floor surface, agitate the fluid against the surface using one or more brushes, and then extract the fluid containing debris off the floor using a squeegee that is pulled along behind the brushes. Periodically, the operator may use a separate burnisher to polish the floor surface.

SUMMARY

In general, this disclosure is directed to a sweeper/scrubber assembly for cleaning a floor surface and related cleaning techniques. The sweeper/scrubber assembly can be attached to a floor surface maintenance machine, which can range from a comparatively small upright unit to a larger walk-behind or ride-on unit. In either case, the sweeper/scrubber assembly can both sweep and scrub the floor surface being cleaned, picking up comparatively large debris in an on-board solid debris collection reservoir without clogging the scrub brushes of the assembly. As a result, an operator may directly deploy the floor maintenance device carrying the sweeper/scrubber assembly without first performing a dry mop or pre-sweep of the floor surface to be cleaned. This can facilitate a more efficient and economical cleaning operation.

In some examples, the sweeper/scrubber assembly includes motorized cleaning brushes that sweep and scrub the floor surface being cleaned. The sweeper/scrubber assembly can also include a solid debris collection reservoir positioned to receive solid debris removed from the surface being cleaned and thrown by the motorized cleaning brushes, thereby providing the sweeping functionality for the assembly. In addition, the sweeper/scrubber assembly may include a cleaning fluid dispensing system and a vacuum squeegee. The cleaning fluid dispensing system can dispense cleaning fluid on the floor surface and/or a motorized cleaning brush. The vacuum squeegee can be positioned against a cleaning brush to extract from the brush cleaning fluid that has been dispensed, scrubbed against the floor using the motorized cleaning brushes, and then carried away from the floor via rotation of the brush. This can provide the scrubbing functionality for the sweeper/scrubber assembly.

To allow the sweeper/scrubber assembly to collect comparatively large debris from the floor surface being cleaned without jamming or clogging the assembly, the solid debris collection reservoir may be offset from the vacuum extraction orifice(s) of the assembly. For example, the solid debris collection reservoir may be positioned rearward of a vacuum orifice that draws air and/or soiled cleaning fluid from the brush to provide the vacuum squeegee. As a result, the solid debris collection reservoir may be an unvacuumed space, e.g., such that the reservoir is not fluidly connected to a vacuum orifice that functions to suck the contents of the reservoir out to a separate debris collection location. This arrangement can be useful as comparatively large debris picked up by the sweeper/scrubber assembly may have a tendency to plug vacuum orifices and/or lines if the debris is pulled from the initial collection reservoir.

To facilitate emptying of the debris collection reservoir, the reservoir may be removable from the sweeper/scrubber assembly by an operator. In some examples, the debris collection reservoir defines a tray that actuates or slides relative to the motorized cleaning brushes to separate the tray from the reminder of the assembly. Although the debris collection reservoir can have a variety of different configurations, in some implementations, the debris collection reservoir is integrated with the vacuum squeegee. The vacuum squeegee may project off of a side edge of the debris collection reservoir and include a tapered housing connectable to a vacuum line. Integrating the debris collection reservoir with the vacuum squeegee can be useful to allow an operator to remove both features from the assembly for simultaneous maintenance cleaning. The operator can remove the combined debris collection reservoir with vacuum squeegee, empty the reservoir of accumulated solid debris, and clear and contaminants that may be blocking the brush-contacting face/orifice of the vacuum squeegee.

In one example, a sweeper/scrubber assembly for cleaning a floor surface is described. The assembly includes a first brush, a second brush, a cleaning fluid dispensing system, a vacuum squeegee, and a solid debris collection reservoir. The first brush is configured to rotate along the floor surface about a first rotational axis. The second brush is positioned adjacent to the first brush and configured to rotate along the floor surface about a second rotational axis. The cleaning fluid dispensing system is configured to dispense cleaning fluid on at least one of the floor surface, the first brush, and the second brush. The vacuum squeegee is positioned against one of the first brush and the second brush. The vacuum squeegee is configured to apply a vacuum suction force to a face of the first brush or the second brush against which the vacuum squeegee is positioned. The solid debris collection reservoir is an unvacuumed space configured to receive solid debris thrown by one or both of the first brush and the second brush.

In other example, a mobile floor cleaner is described that includes a mobile support and a sweeper/scrubber assembly. The mobile support has a powered drive for advancing the mobile support over a floor surface to be cleaned. The sweeper/scrubber assembly is carried by the mobile support and includes a first brush, a second brush, a cleaning fluid dispensing system, a vacuum squeegee, and a solid debris collection reservoir. The first brush is configured to rotate along the floor surface about a first rotational axis. The second brush is positioned adjacent to the first brush and configured to rotate along the floor surface about a second rotational axis. The cleaning fluid dispensing system is configured to dispense cleaning fluid on at least one of the floor surface, the first brush, and the second brush. The vacuum squeegee is positioned against one of the first brush and the second brush. The vacuum squeegee is configured to apply a vacuum suction force to a face of the first brush or the second brush against which the vacuum squeegee is positioned. The solid debris collection reservoir is an unvacuumed space configured to receive solid debris thrown by one or both of the first brush and the second brush.

In another example, a method is described that includes conveying a sweeper/scrubber assembly over a floor surface to be cleaned without dry sweeping or mopping a solid debris from the floor surface before conveying the sweeper/scrubber assembly over the floor surface. The method specifies that conveying the sweeper/scrubber assembly over the floor surface includes rotating a first brush along the floor surface about a first rotational axis and rotating a second brush positioned adjacent to the first brush along the floor surface about a second rotational axis. The method also includes dispensing a cleaning fluid on at least one of the floor surface, the first brush, and the second brush. The method further involves vacuum squeegeeing at least one of the first brush and the second brush by applying a vacuum suction force to a face of the first brush or the second brush against which a vacuum squeegee is positioned. In addition, the method recites collecting the solid debris in a solid debris collection reservoir that is an unvacuumed space that receives solid debris thrown by one or both of the first brush and the second brush.

The details of one or more examples are set forth in the accompanying drawings and the description below. Other features, objects, and advantages will be apparent from the description and drawings, and from the claims.

BRIEF DESCRIPTION OF DRAWINGS

FIGS. 7A-7C illustrate three example mobile platforms on which a sweeper/scrubber assembly according to disclosure may be mounted and used.

DETAILED DESCRIPTION

In general, this disclosure is directed to a sweeper/scrubber assembly for cleaning a floor surface. The sweeper/scrubber assembly can be attached to a floor surface maintenance machine and can both sweep and scrub the floor surface being cleaned. The sweeper/scrubber assembly may include one or multiple cylindrical cleaning brushes that sweep and scrub the floor surface. The sweeper/scrubber assembly can also include a solid debris collection reservoir positioned to receive solid debris removed from the surface being cleaned and thrown by the motorized cleaning brushes. The solid debris collection reservoir may be offset from any vacuum suction features on the sweeper/scrubber assembly, e.g., such that solid debris thrown into the reservoir is not sucked into the vacuum system which may cause plugging. In some configurations, the sweeper/scrubber assembly includes a vacuum squeegee positioned against one or more of the multiple cylindrical cleaning brushes. The vacuum squeegee can provide a localized vacuum force to remove soiled cleaning liquid, small debris, and/or other contaminations from the surface of the cleaning brush against which it is positioned.

Figure 1:
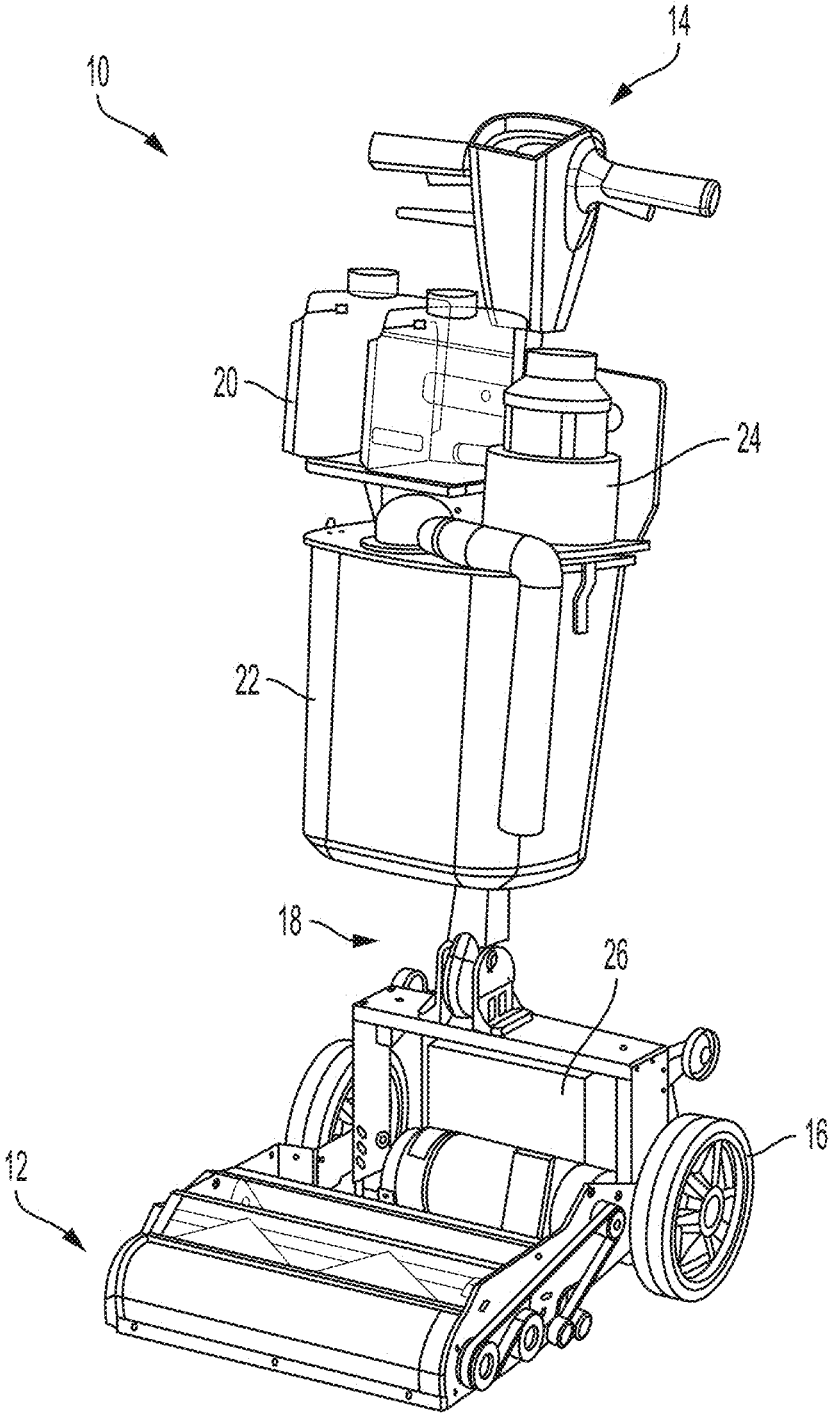
FIG. 1 is a perspective view of an example floor surface maintenance machine that includes an example sweeper/scrubber assembly according to the disclosure.

FIG. 1 is a perspective view of an example floor surface maintenance machine 10 that includes an example sweeper/scrubber assembly 12 according to the disclosure. Floor maintenance machine 10 is illustrated as a walk-behind device having a vertically upright handle 14 that may articulate relative to sweeper/scrubber assembly 12 for operator ergonomic convenience. Floor maintenance machine 10 can include one or more driven wheels 16 to convey the device over a floor surface to be cleaned or, in other configurations, can be propelled by the force of an operator without supplying power to wheels 16. Sweeper/scrubber assembly 12 can be implemented on a number of mobile platforms, including those described in greater detail below with respect to FIGS. 7A-7C.

In the example of FIG. 1, floor maintenance machine 10 includes a chassis or support frame 18 to which sweeper/scrubber assembly 12 is mounted. Chassis 18 carries a cleaning fluid reservoir 20, a waste fluid reservoir 22, and a vacuum 24. Cleaning fluid held within cleaning fluid reservoir 20 can be dispensed through a fluid line extending from the cleaning fluid reservoir to sweeper/scrubber assembly 12. The cleaning fluid can be dispensed on one or more brushes within the sweeper/scrubber assembly and/or directly on the floor surface to be cleaned, as will be described in greater detail below. Dirty fluid having passed over the surface to be cleaned and/or retained within the one or more brushes can be extracted off the surface of the one or more brushes via a vacuum squeegee in fluid communication with vacuum 24. Vacuum 24, which may be implemented as a vacuum motor or vacuum pump, can generate a vacuum force effective to draw liquid and/or solids contained on a brush to which the vacuum is communicatively coupled into waste fluid reservoir 22. Accordingly, a waste fluid line/vacuum line can extend from sweeper/scrubber assembly 12 to waste fluid reservoir 22.

In the illustrated example, floor maintenance machine 10 carries an onboard power source 26, which is illustrated in the form of one or more batteries. Power source 26 can power wheels 16 to propel floor maintenance machine 10 as well as the other electrically controllable features machine. For example, power source 26 can also supply power for driving rotation of one or more brushes within sweeper/scrubber assembly 12. In addition to or in lieu of an onboard battery, floor maintenance machine 10 may be powered by an internal combustion engine or powered through an electrical cord that is connectable to wall mains power.

Sweeper/scrubber assembly 12 can be mechanically and/or electrically connected to chassis 18 and/or the components contained thereon to define an integrated floor maintenance machine. As described in greater detail below in connection with FIGS. 2 and 3, sweeper/scrubber assembly 12 can include one or more brushes that are configured for sweeping and/or scrubbing on the floor surface to be cleaned. The operator running floor maintenance machine 10 can control the delivery of cleaning fluid to the floor surface via sweeper/scrubber assembly 12 through the manipulation of controls. Cleaning fluid can be delivered to the floor surface to perform a wet scrubbing operation. Conversely, delivery of cleaning fluid may be withheld to perform a dry sweeping operation. Typical cleaning fluids used with sweeper/scrubber assembly 12 may include water (e.g., electrically activated water, nanobubble containing water) and water-based cleaning solutions (e.g., containing detergent or other cleaning aids).

Through control of the delivery of cleaning fluid to sweeper/scrubber assembly 12 via controls, the assembly can perform wet and/or dry cleaning operations on the surface being cleaned. Sweeper/scrubber assembly 12 can be used on any type of hard or soft surface, as described herein. For example, sweeper/scrubber assembly 12 may be used to clean composite floor surfaces composed of multiple different types of flooring materials. In retail establishments, for example, the floor surface to be cleaned may include sections of hard surface flooring (e.g., wood flooring, title, stone) abutting sections of soft surface flooring (e.g. carpeting). Sweeper/scrubber assembly 12 can be used to clean both the hard surface flooring and the soft surface flooring sections of the floor surface to be cleaned, transitioning from one flooring surface to a different type of flooring surface without needing to reconfigure the assembly.

In instances where sweeper/scrubber assembly 12 includes a vacuum squeegee to withdraw liquid and/or debris from the surface of a brush within sweeper/scrubber assembly 12, floor maintenance machine 10 may operate without a floor-facing liquid removal device. For example, typical floor cleaning machines include a squeegee or other suction device that is positioned rearward of the cleaning head and cleaning fluid dispensing location for the machine. The squeegee or other suction device collects dirty water and/or cleaning fluid from the surface being cleaned. For instance, the machine may have a rubber squeegee that is dragged along the floor being cleaned and a vacuum suction orifice to withdraw liquid swept up by the squeegee into a holding tank.

In accordance with some configurations of the present application, floor maintenance machine 10 may be configured without any floor facing or floor contacting liquid collection elements, such as a squeegee and/or vacuum collection system. Rather, residual liquid may be withdrawn directly from a brush within sweeper/scrubber assembly 12 instead of being withdrawn directly from a floor surface being cleaned. This arrangement can be useful to minimize the footprint of floor maintenance machine 10, enhancing the mobility of the device and the ability of the device to access tight spaces, such as under and around merchandise display shelves in convenience stores. That being said, in other configurations, a floor maintenance machine 10 may include a floor facing or contacting liquid removal system.

Figure 2:
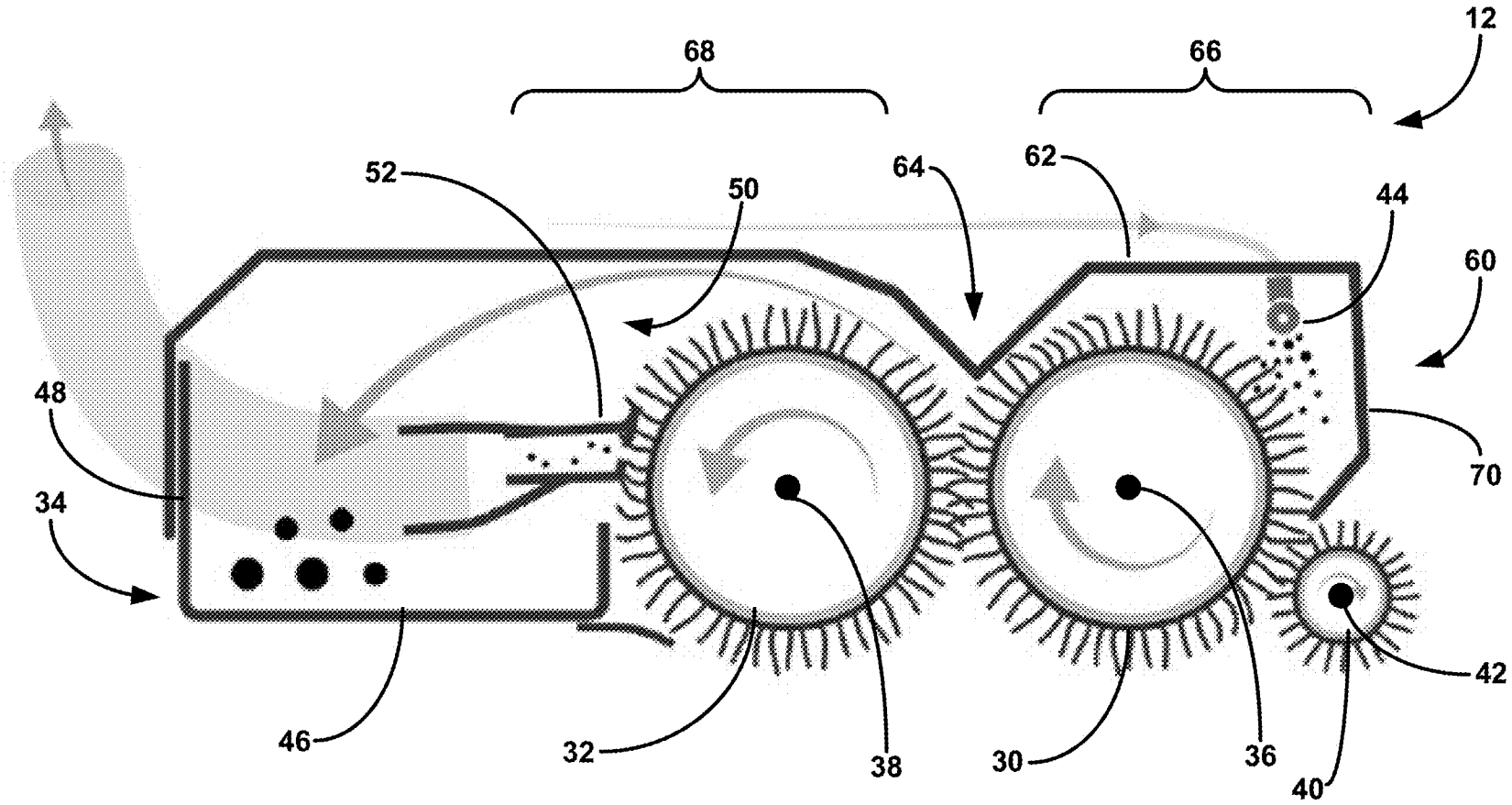
FIG. 2 is a side sectional view showing an example configuration of a sweeper/scrubber assembly that can be used on the floor maintenance machine in FIG. 1.
Figure 3:
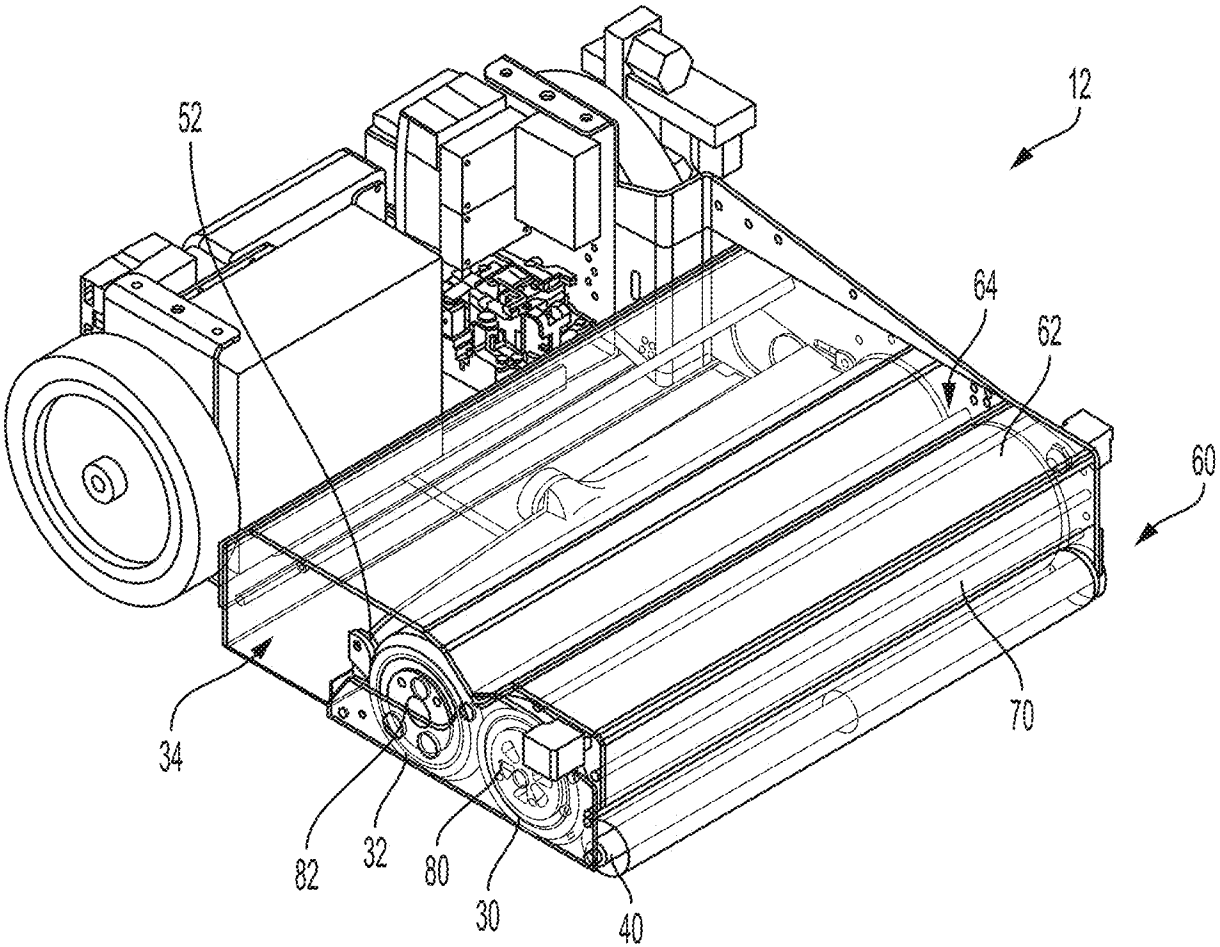
FIG. 3 is a perspective view of an example configuration of the sweeper/scrubber assembly shown in FIG. 2.

FIG. 2 is a side sectional view showing an example configuration of sweeper/scrubber assembly 12 that can be used on floor maintenance machine 10 in FIG. 1. FIG. 3 is a perspective view of an example configuration of sweeper/scrubber assembly 12 shown in FIG. 2. In the example of FIGS. 2 and 3, sweeper/scrubber assembly 12 includes at least two brushes, including a first brush 30 and a second brush 32. Sweeper/scrubber assembly 12 also includes a solid debris collection reservoir 34. First brush 30 is configured to rotate around the first rotational axis 36. Second brush 32 is configured to rotate around a second rotational axis 38. First brush 30 and second brush 32 are positioned each adjacent to each other, such as parallel to each other and spaced apart from each other a distance effective to allow the outer surfaces of the respective brushes to contact and/or intermesh with each other during rotation.

In the example of FIGS. 2 and 3, second brush 32 is positioned rearwardly of first brush 30 in the direction of forward movement of sweeper/scrubber assembly 12. During operation, first brush 30 and second brush 32 may rotate in counter rotational directions about the respective axes during operation of sweeper/scrubber assembly 12. For example, first brush 30 may be configured to rotate in direction that moves solid debris on the floor surface being cleaned rearwardly toward second brush 32. First brush 30 may convey debris from the floor surface being cleaned rearwardly and upwardly into second brush 32 and/or back toward solid debris collection reservoir 34. By contrast, second brush 32 may convey debris from the floor surface being cleaned and/or received from first brush 30 rearwardly and downwardly into solid debris collection reservoir 34. Thus, solid debris on the floor surface being cleaned may be swept under first brush 30, then swept between the first and second brushes 30, 32, followed by being swept over the top of second brush 32 before being deposited into reservoir 34. Other brush rotation configurations are possible, and it should be appreciated that the disclosure is not limited in this respect. In any configuration, first brush 30 and second brush 32 may scour the floor surface being cleaned at the same time the brushes are sweeping debris from the floor and into the solid debris collection reservoir 34.

In general, sweeper/scrubber assembly 12 includes at least one rotational brushes to sweep and scrub a floor surface although may include additional rotational brushes, such as two or more brushes. In the illustrated configuration, for example, sweeper/scrubber assembly 12 includes a third brush 40 positioned forwardly of first brush 30 and second brush 32. Third brush 40 is configured to rotate about a third rotational axis 42. Third brush 40 may function to knock-down dust and/or debris, causing the floor contaminants to be drawn into sweeper/scrubber assembly 12 rather than blown forward out of the path of the sweeper/scrubber assembly during movement. An example single brush configuration is described in greater detail with respect to FIG. 8. As a further design option, sweeper/scrubber assembly 12 may include a clutch engageable by a user to stop motion of the one or more brushes, e.g., when going in reverse to squeegee or vacuum water with the housing instead of leaving water left out front.

During operation of sweeper/scrubber assembly 12, first brush 30 and second brush 32 may be driven brushes that are powered by one or more motors to provide driven rotational motion independent of the movement of the overall assembly. The rotational movement of the brushes may generate air movement pushing outward in front of sweeper/scrubber assembly 12, in a direction of forward movement of the assembly. This airstream caused by the rotating brushes may have a tendency to blow dust and other debris out of the path of movement of the sweeper/scrubber assembly before the assembly passes over the debris to capture the debris during cleaning. The addition of one or more leading rollers, such as third brush 40, can disrupt the airstream generated by first brush 30 and second brush 32. For example, third brush 40 may be a brush that is not driven (such that the brush rotates at a speed and direction corresponding to movement of sweeper/scrubber assembly 12) or may be a brush that is driven at a slower rotational rate then first brush 30 and/or second brush 32. As a result, third brush 40 may help block the airstream generated by first brush 30 and second brush 32 while not generating its own significant airstream that will push debris out of the path of the assembly. This can increase the capture rate of floor debris by sweeper/scrubber assembly 12 by helping to prevent the floor debris from being inadvertently blown out of the path of the assembly by a leading airstream. When driven, third brush 40 may be configured to rotate in a direction that causes debris on the floor surface being cleaned to travel under the bottom of the roller (rather than other the top of the roller) before being contacted by first brush 30.

Sweeper/scrubber assembly 12 can be operated in a dry sweeping and scrubbing mode in which cleaning fluid is not dispensed to the assembly or floor surface being cleaned. In this mode of operation, first brush 30 and second brush 32 may rotate without concurrent dispensing of cleaning fluid. Sweeper/scrubber assembly 12 can also be operated in a wet sweeping and scrubbing mode in which cleaning fluid is dispensed to the assembly during rotation of the brushes. To facilitate distribution of cleaning fluid, sweeper/scrubber assembly 12 can include one or more cleaning fluid dispensing orifices 44 which are in fluid communication with cleaning fluid reservoir 20 (FIG. 1) via a cleaning fluid line.

The cleaning fluid dispensing orifice 44 can be positioned to dispense cleaning fluid on first brush 30, on second brush 32, and/or directly on the floor surface being cleaned in addition to or in lieu of dispensing on the one or more brushes. In the configuration of FIG. 2, cleaning fluid dispensing orifice 44 is illustrated as being positioned to dispense cleaning fluid on a leading side of first brush 30. By dispensing cleaning fluid on first brush 30, the brush may be wetted such that the floor surface being cleaned is moistened via the brush rather than direct application of cleaning fluid. In practice, cleaning fluid dispensing orifice 44 may extend along substantially an entire length of the brush intended to be wetted and/or may be implemented via a plurality of orifices at spaced intervals along the length of the brush so as to distribute the cleaning fluid substantially uniformly along the length of the brush.

Figure 8:
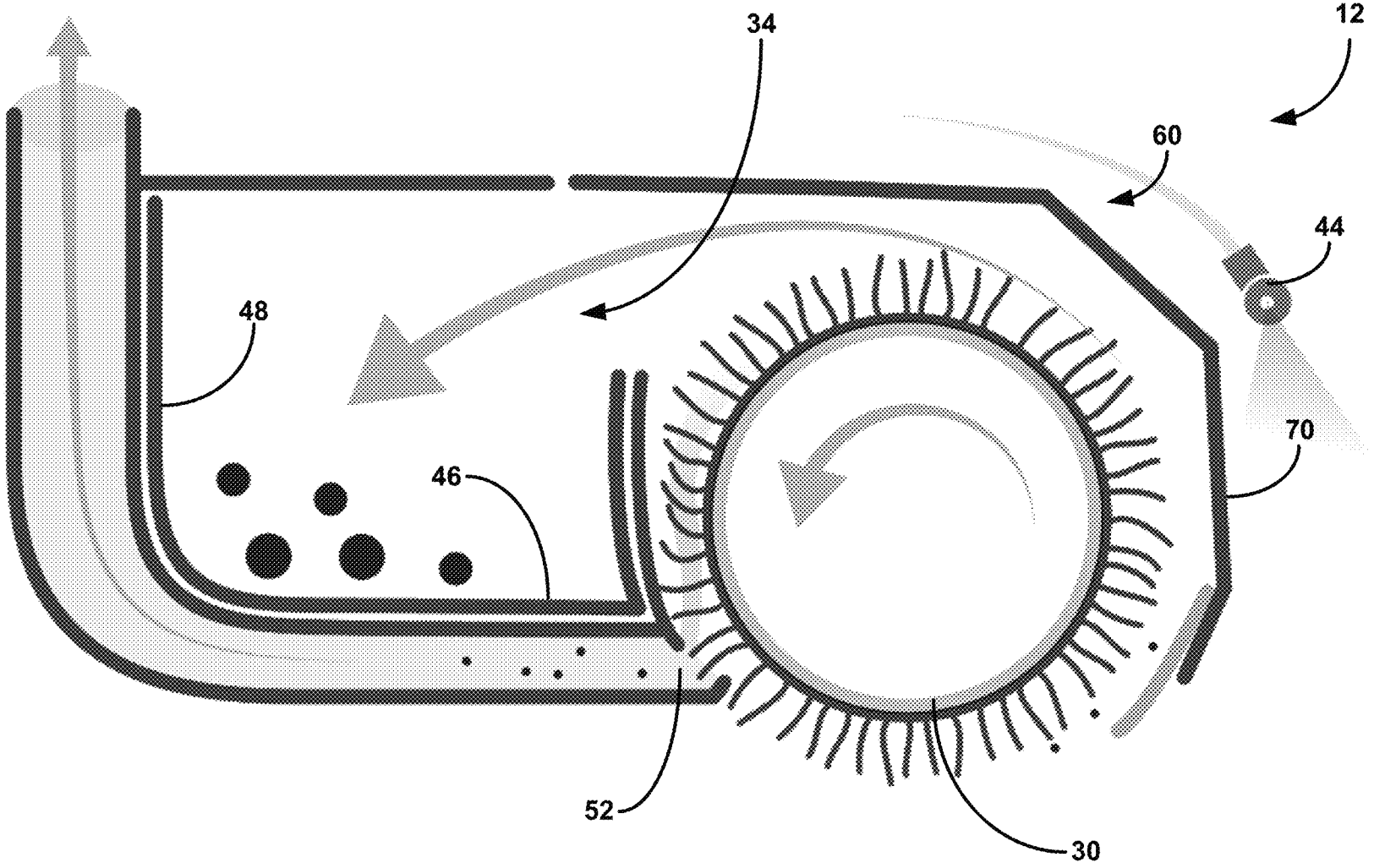
FIG. 8 is a side sectional view of an example sweeper/scrubber assembly showing a configuration of the assembly utilizing a single brush.

When cleaning fluid dispensing orifice 44 is positioned to wet first brush 30, cleaning fluid may be transferred from the first brush to the floor surface being cleaned via rotation of the first brush and thereafter picked up by the trailing second brush 32. Thus, second brush 32 may also be wetted during operation of sweeper/scrubber assembly 12 even if cleaning fluid is not dispensed directly on the brush. That being said, in some configurations, a cleaning fluid dispensing orifice 44 may be positioned to dispense cleaning fluid on second brush 32 in addition to or in lieu of first brush 30. Further, in yet other configurations, cleaning fluid dispensing orifice 44 may be positioned outside of a housing of sweeper/scrubber assembly 12 to dispense fluid on a floor surface to be cleaned, e.g., as illustrated in FIG. 8.

Solid debris present on the floor surface being cleaned may be swept up by first brush 30 and second brush 32 and conveyed to solid debris reservoir 34. For example, a leading edge of first brush 30 may contact solid debris on the floor surface being cleaned as sweeper scrubber assembly 12 is conveyed over the debris. Rotational motion of first brush 30 may cause the solid debris contacted by the leading edge of the roller to sweep the debris off the floor surface and up into the space between first brush 30 and second brush 32. The rotational motion of second brush 32 may then cause the solid debris to be conveyed over the top of the brush and back into solid debris reservoir 34.

Solid debris reservoir 34 may be a space, cavity, or other compartment positioned to receive debris swept off the floor surface being cleaned by first brush 30 and second brush 32. In the illustrated example, solid debris reservoir 34 is positioned rearwardly of first brush 30 and second brush 32. Solid debris reservoir 34 can be positioned at other locations, such as forward of first brush 30 and second brush 32. In these configurations, the rotational direction of first brush 30 and/or second brush 32 may be such that debris swept off the floor surface being cleaned is thrown forwardly instead of rearwardly.

Solid debris reservoir 34 may include at least a bottom wall 46 and a rear wall 48 which bound the reservoir for containing debris discharged to the reservoir. Solid debris reservoir 34 may define an opening 50 adjacent to and rearward of second brush 32 through which solid debris can discharge off of the brush and into the debris reservoir. While debris reservoir 34 is described as being configured to collect solid debris during operation of sweeper/scrubber assembly 12, it should be appreciated that moisture may also be thrown into the reservoir during operation of the assembly.

To help remove excess moisture from the floor surface being cleaned, sweeper/scrubber assembly 12 may include a vacuum squeegee 52. Moisture may be present on the floor surface being cleaned in the form of liquid floor contaminants (e.g., moisture tracked in on footwear, spilled liquids) and/or dispensed cleaning fluid. In either case, configuring sweeper/scrubber assembly 12 with one or more vacuum squeegees 52 may be useful to help draw liquid lifted off of the floor surface being cleaned by sweeper/scrubber assembly 12.

In general, vacuum squeegee 52 may define a vacuum orifice positioned adjacent to a brush of sweeper/scrubber assembly 12 that is in communication with vacuum 24 (FIG. 1) via a vacuum line. Vacuum squeegee 52 may be positioned against an outer surface of the brush from which the squeegee is intended to draw off moisture. For example, vacuum squeegee 52 may contact the nap or bristles of the brush, optionally compressing the brush surface as it contacts the squeegee, and also include one or more orifices through which vacuum pressure is drawn. In other configurations, vacuum squeegee 52 may be positioned against an outer surface of the brush from which the squeegee is intended draw off moisture but slightly offset such that the squeegee does not physically contact the outer surface of the brush during operation. In general, the closer vacuum squeegee 52 is positioned to the brush from which it is intended to draw off moisture, the stronger the vacuum force that will be applied to the brush for removing moisture.

In practice, vacuum squeegee 52 may extend along substantially an entire length of the brush from which moisture is intended to be removed. Vacuum squeegee 52 may define a single orifice extending substantially along the entire length of the brush or may be divided into a plurality of orifices at spaced intervals along the length of the brush. In either case, vacuum squeegee 52 may be implemented to remove moisture substantially uniformly along the length of the brush.

In the example of FIGS. 2 and 3, sweeper/scrubber assembly 12 is illustrated as having a single vacuum squeegee 52 positioned against second brush 32. This arrangement may be useful to provide a comparatively wet leading first roller 30 (e.g., on which cleaning fluid dispensing orifice 44 discharges cleaning fluid) and a comparatively dry trailing second roller 32. Accordingly, first roller 30 may function to wet the floor surface being cleaned while second brush 32 may function to help dry the floor surface being cleaned, with both rollers providing sweeping and/or scrubbing functionality during rotation. This may help allow sweeper/scrubber assembly 12 to be implemented without a ground contacting or facing squeegee or vacuum orifice, as discussed above. In other examples, a vacuum squeegee 52 may be positioned against first roller 30 in addition to or in lieu of second brush 32 or may be implemented in other locations in the assembly.

Independent of the number and location of vacuum squeegee orifices used on sweeper/scrubber assembly 12, the vacuum orifices may be offset from solid debris collection reservoir 34. The vacuum orifices may be offset so that the space defined by solid debris collection reservoir 34 is substantially isolated from vacuum pressure drawn through the vacuum orifices (e.g., such that debris thrown into the debris collection reservoir is not drawn by the vacuum pressure out of the reservoir). Accordingly, solid debris collection reservoir 34 may be an unvacuumed space. The contents in the solid debris collection reservoir 34 may be exposed to ambient pressure or may be exposed to above ambient pressure during operation (e.g., due to wind pressure generated off of the rotating brushes and directed back into the reservoir). Thus, the debris thrown into solid debris collection reservoir 34 may remain in the reservoir until it is emptied rather than being drawn through and/or back out of the reservoir via a vacuum force generated by the floor maintenance machine 10. Substantially pressure isolating solid debris collection reservoir 34 from one or more vacuum orifices that draw moisture out of sweeper/scrubber assembly 12 may be useful to facilitate the collection of comparatively large debris off the floor surface being cleaned.

In traditional vacuum floor cleaning systems, the floor surface needs to be swept to remove comparatively large debris before running the vacuum floor cleaning system over the soiled surface. This is because the large debris has a tendency to plug up the vacuum system of the cleaning system. In accordance with some example configurations of the present disclosure, however, sweeper/scrubber assembly 12 may be utilized to clean floor surfaces with comparatively large debris without requiring pre-sweeping. Rather, sweeper/scrubber assembly 12 may be advanced over the floor surface without performing a preliminary pre-sweeping or mopping, thereby simultaneously sweeping the debris from the surface and also scrubbing the surface.

The size and type of debris that may be removed by sweeper/scrubber assembly 12 may vary depending on the specific configuration of the assembly and the environment in which it is deployed. Example types of debris that sweeper/scrubber assembly 12 may be configured to pick up and deposit in solid debris collection reservoir 34 include, but are not limited to, receipts, straws, straw wrappers, napkins, coins, pencils, rubber bands, sticks, dirt, rocks and gravel, sand, and other debris. These types of debris may have a major length ranging from less than 1 inch to greater than 3 inches, such as from 0.1 inches to 7 inches. While sweeper/scrubber assembly 12 may be usefully deployed without performing a pre-sweeping of the surface to be cleaned, it should be appreciated that in other applications an operator may pre-sweep the surface before using the sweeper/scrubber assembly.

The design dimensions of sweeper/scrubber assembly 12 may be controlled based on the types of debris the assembly is intended to pick up during operation. Different pinch points may exist on the assembly, which may limit the size of debris that can be collected using the assembly. One potential pinch point location is the distance between the core of the third brush 40 (e.g., the non-compressible surface of the brush to which the brush fiber is adhered) and the floor surface being cleaned. This distance may be controlled, e.g., by controlling the positioning of the third brush and/or the configuration of the brush used. In some examples, the distance between the incompressible outer surface of third brush 40 and the floor surface being cleaned is set to be at least 3 mm, such as from 4 mm to 15 mm, or from 5 mm to 10 mm. This distance can control the size of debris initially entering the sweeper/scrubber assembly 12 without requiring the front end of the assembly to be rotated or lifted upwardly.

Another potential pinch point location in sweeper/scrubber assembly 12 is the distance between the incompressible surface of first brush 30 (e.g., the core of the brush) and the incompressible surface of second brush 32 (e.g., the core of the brush) in the space between the two brushes. This distance can dictate the maximum sized debris that can be pushed between the two brushes and collected in debris collection reservoir 34. In some configurations, the distance between the incompressible surface of first brush 30 and the incompressible surface of second brush 32 (measured at the shortest spacing location between the brushes collinear with the brushes axes of rotation) may range from 5 mm to 50 mm, such as from 10 mm to 25 mm.

Sweeper/scrubber assembly 12 may include a housing 60 enclosing first brush 30 and second brush 32. For example, housing 60 may extend over a top surface of the brushes and, optionally, partially or fully down the sides of the brushes towards the floor surface on which the assembly is positioned. The resulting enclosed space defined by housing 60 may be open on the bottom end to allow the brushes contained therein to contact the floor surface being cleaned. In different configurations, solid debris collection reservoir 34 may be integrated into housing 60 (e.g., and removable therefrom for emptying) or may be separate from housing 60 and positioned rearward thereof.

Housing 60 can have a variety of different sizes and shapes depending on the configuration of sweeper/scrubber assembly 12. With reference to FIG. 2, housing 60 may contain first brush 30, second brush 32, cleaning fluid dispensing orifice 44, vacuum squeegee 52, and solid debris collection reservoir 34. When configured with third brush 40, housing 60 may also enclose the third brush, or the third brush may be positioned forward of housing 60. In the illustrated configuration, third brush 40 is illustrated as being positioned outside of housing 60 such that the housing does not enclose the brush. This arrangement may be useful to segregate air movement generated by first brush 30 and second brush 32 from the leading face of sweeper/scrubber assembly 12 and third brush 40. As discussed above, third brush 40 may be used to capture debris on the floor surface being cleaned and help prevent an airstream generated by rotational movement of first brush 30 and second brush 32 from pushing the debris out of the path of the sweeper/scrubber assembly.

Housing 60 may have a shape that generally conforms to the shape of first brush 30 and second brush 32. This can help ensure that solid debris picked up by the brushes is carried through the housing and back to solid debris collection reservoir 32 rather than ensnared in the brushes or otherwise trapped in the housing. For example, housing 60 may define a top surface 62 extending over first brush 30 and second brush 32. Top surface 62 may be generally parallel to the floor surface on which sweeper/scrubber assembly 12 is positioned in the region where the surface extends over the top of the brushes. The top surface of housing 60 may include a downward step 64 in the space between first brush 30 and second brush 32. Accordingly the top surface 62 of housing 60 may be closer to the surface on which sweeper/scrubber assembly 12 is positioned in the region between the brushes then over the brushes. This step 64 can help prevent large debris from becoming entrained within the housing. When so configured, housing 60 may define a first brush pocket 66 and a second brush pocket 68 on either side of the step 64. First brush pocket 66 may be an internal cavity of housing 60 in which first brush 30 is positioned. Second brush pocket 68 may be an internal cavity of housing 60 in which second brush 32 is positioned. The two brush pockets may be directly adjacent and connected to each other.

When configured as illustrated in FIGS. 2 and 3, housing 60 may include a front wall 70 that extends downwardly toward the floor surface being cleaned. In some configurations, front wall 70 or a portion thereof is angled rearwardly in a region between first brush 30 and third brush 40. This rearward projection of front wall 70 can help isolate first brush 30 inside of housing 60 from third brush 40 outside of the housing, e.g., to prevent airflow generated by the rotation of the first brush from pushing debris out of the cleaning path of the assembly. This rearward projection of front wall 70 can also help prevent cleaning fluid dispensed through fluid dispensing orifice 44 from discharging directly on third brush 40 (when used), allowing debris touched by the third brush to wrap around the brush and enter the housing if not pushed into the housing on the first rotation.

Solid debris collection reservoir 34 can have a variety of different sizes and shapes. In some examples, solid debris collection reservoir 34 defines an elongated tray having a length extending parallel to the length of the first brush 30 and/or the second brush 32. For example, solid debris collection reservoir 34 may define a tray having a length substantially equal to (or even greater than) a length of second brush 32 behind which the reservoir 34 is positioned.

During operation of sweeper/scrubber assembly 12, solid debris collection reservoir 34 may fill with contaminants picked up from the floor surface being cleaned. To allow the reservoir to be conveniently emptied, solid debris collection reservoir 34 may be removable from a remainder of the assembly. When housing 60 is designed to contain solid debris collection reservoir 34, the housing may have an opening through which the solid debris collection reservoir can be removed. In some examples, the removal opening is through top surface 62 of housing 60. In other examples, such as the example of FIGS. 2 and 3, one or both sides surfaces of housing 60 contains an opening through which solid debris collection reservoir 34 is removed. Solid debris collection reservoir may be slid out of housing 60 parallel to first brush 30 and/or second brush 32 to remove the reservoir from the housing. One or more locking features may be included to releasably lock the reservoir in the housing.

When sweeper/scrubber assembly 12 is configured with vacuum squeegee 52, the vacuum squeegee may or may not also be removable from housing 60. Configuring vacuum squeegee 52 to be removable from housing 60 may be useful to facilitate cleaning of the vacuum orifice on the squeegee, allowing any buildup debris partially or fully blocking the orifice or portion thereof to be removed.

Figure 4A:
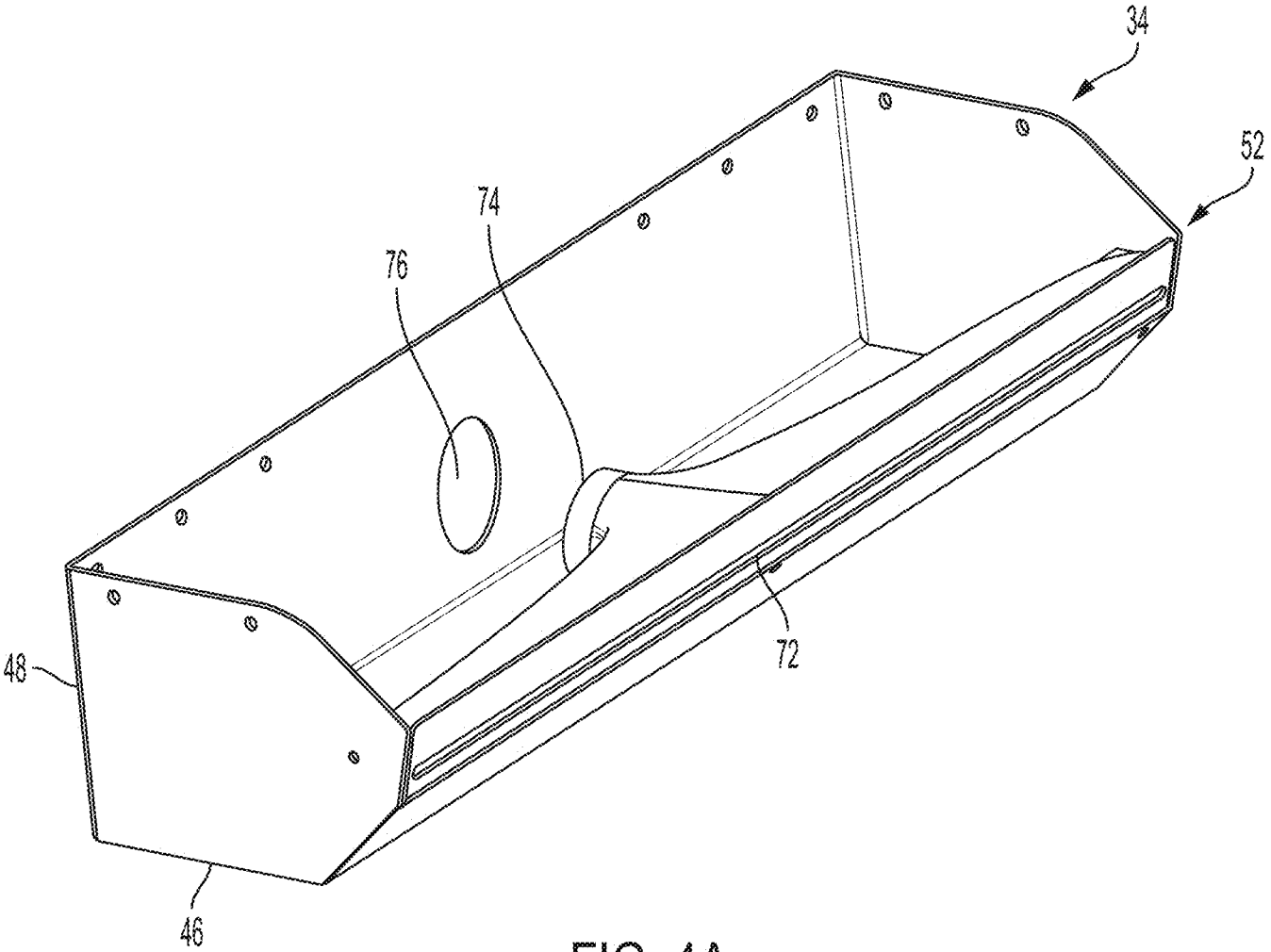
FIGS. 4A and 4B are perspective illustrations of example debris collection reservoirs and vacuum squeegees that may be used on the sweeper/scrubber assembly of FIGS. 2, 3, and 8.
Figure 4B:
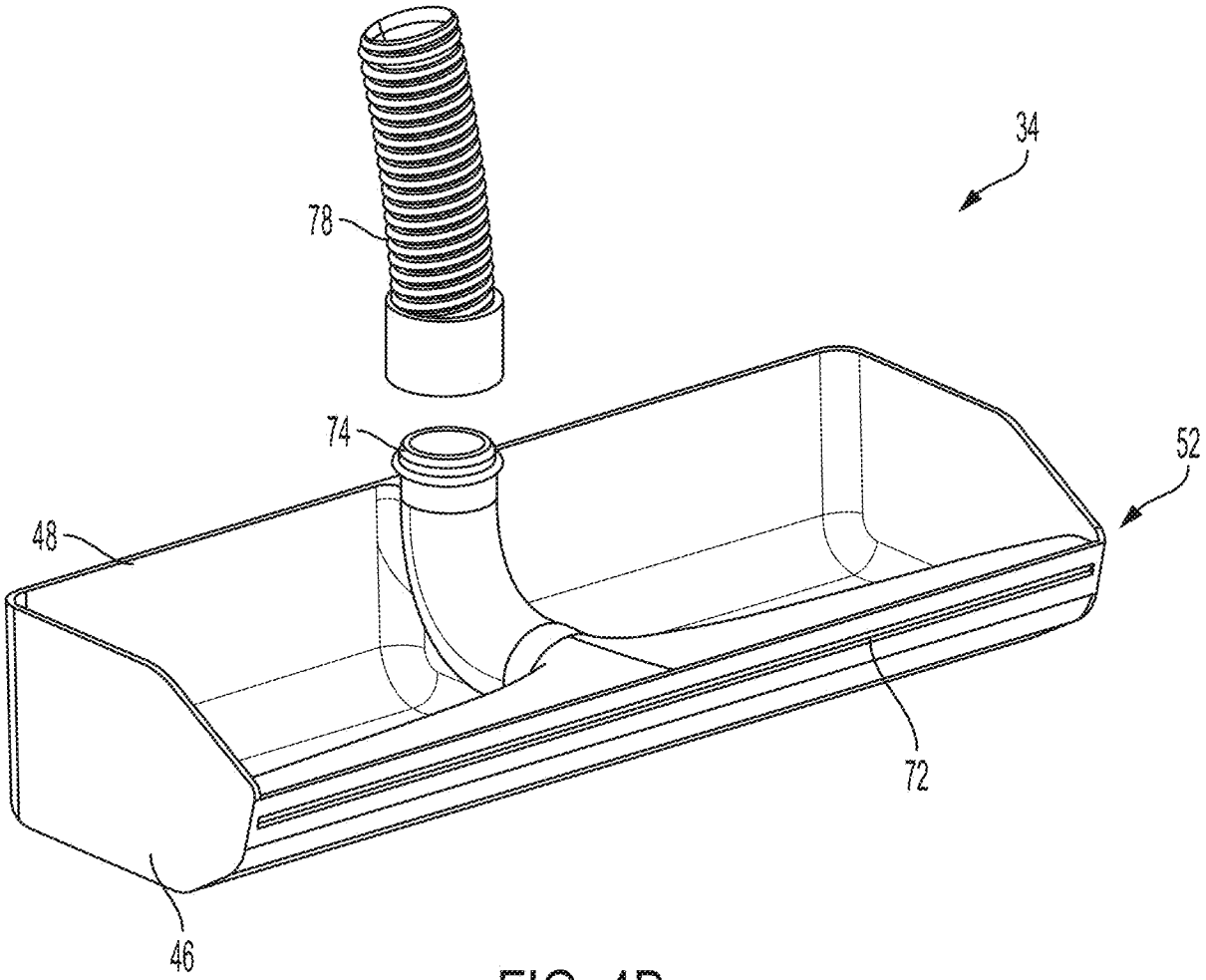

FIGS. 4A and 4B are perspective illustrations of an example debris collection reservoir 34 and vacuum squeegee 52 that may be used on a sweeper/scrubber assembly according to the disclosure. In the illustrated example, vacuum squeegee 52 is integrated with debris collection reservoir 34 to provide a unitary structure (e.g., such that the vacuum squeegee cannot be separated from the debris collection reservoir without disassembling or damaging the structure). Vacuum squeegee 52 in the examples defines a throat extending from a leading end 72 that is positionable against second brush 32 to a trailing end 74 connectable to a vacuum hose. The vacuum orifice defined by vacuum squeegee 52 may narrow in cross-sectional height but expand out in length moving from the trailing end 74 to the leading end 72. In this configuration, vacuum squeegee 52 defines a single leading end orifice having a length substantially equivalent to the length of second brush 32 although, as discussed above, can be implemented with different configurations. A vacuum squeegee according to disclosure may have a configuration consistent with that illustrated in FIGS. 4A and 4B even when implemented as a separate component from debris collection reservoir 34.

In the configuration of FIGS. 4A and 4B, however, where debris collection reservoir 34 and vacuum squeegee 52 are a unitary structure, the reservoir and vacuum squeegee features may be simultaneously removed from housing 60 and reinstalled in the housing. For example, an operator may open a side access panel on housing 60 and/or otherwise unlock the reservoir/squeegee structure from the housing and slide the reservoir/squeegee structure out of the housing. Once removed, the operator may dump the contents of the reservoir and clean the squeegee orifice. For example, an operator may use a hose to flush the squeegee orifice and the debris collection reservoir. In either case, once suitably emptied, the operator can slide the reservoir/squeegee structure back into housing 60. In this way, integrating debris collection reservoir 34 with vacuum squeegee 52 can facilitate efficient removal and cleaning of both features of the sweeper/scrubber assembly.

When configured as illustrated, trailing end 74 of the vacuum squeegee orifice may extend partially or fully through the debris collection reservoir 34. This can help ensure that the leading end 72 of the vacuum squeegee orifice is positioned forward of the debris collection reservoir such that the debris collection reservoir is not substantially exposed to vacuum pressure during operation. The trailing end 74 of the vacuum squeegee orifice may be connectable to a vacuum tubing line.

Figure 5:
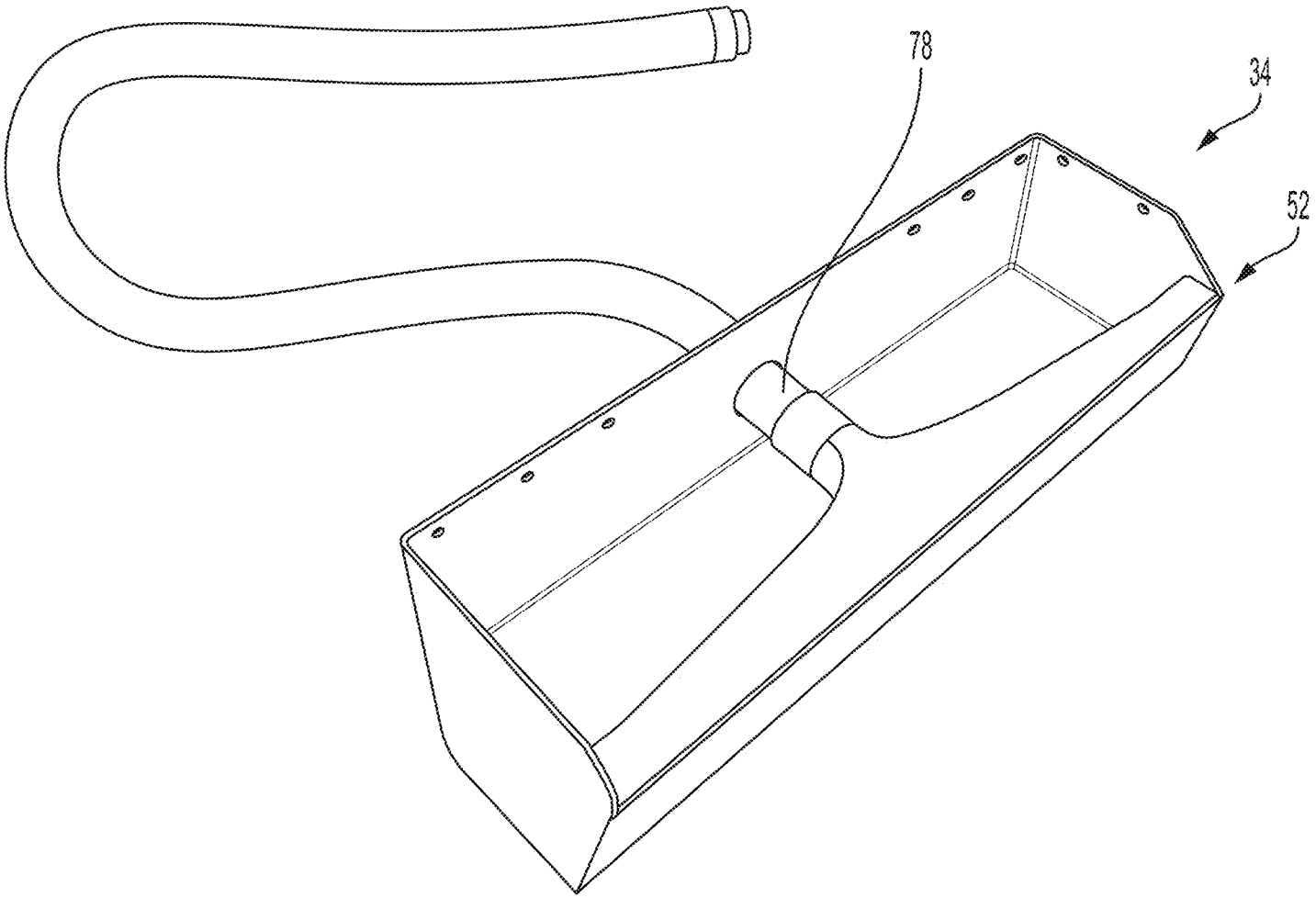
FIG. 5 shows an example flexible vacuum line connected to the example debris collection reservoir and vacuum squeegee of FIG. 4.

In the example of FIG. 4A, rear wall 48 of debris collection reservoir 34 may include an aperture 76 through which a flexible vacuum line is configured to extend to connect to trailing end 74 of the vacuum squeegee. In the example of FIG. 4B, the vacuum squeegee orifice includes a bend (e.g., approximately 90 degree bend) that angles trailing end 74 upwardly for connection to a vacuum line 78. In either configuration, an operator may detach the flexible vacuum line from vacuum squeegee 52 and separate the line from the reservoir/squeegee structure before pulling the structure out of housing 60. After reinstalling the reservoir/squeegee structure in housing 60, the operator may reattach the vacuum line. FIG. 5 shows an example flexible vacuum line 78 connected to the trailing end 74 of the vacuum squeegee of FIG. 4A in this manner.

With further reference to FIGS. 2 and 3, sweeper/scrubber assembly 12 includes multiple brushes which, in the illustrated configuration, is shown implemented with first brush 30, second brush 32, and third brush 40. One or more of the brushes in sweeper/scrubber assembly 12 may be driven brushes. Such a brush may be coupled to a motor that drives rotation of the brush. For example, first brush 30 and second brush 32 may typically be connected to one or more motors to drive rotation of the brushes during operation of the assembly. Third brush 40 may also be coupled to a motor to drive rotation of the brush or, alternatively, third brush 40 may be an undriven idler brush that rotates concurrent with movement of the overall sweeper/scrubber assembly 12 but does not otherwise independently rotate. In either case, in some examples, third brush 40 is configured to rotate at a slower rate than first brush 30 and second brush 32. Rotating third brush 40 at a slower rate than the other two brushes may be helpful to prevent generation of an undesirable air current that can push debris out of the path of the assembly.

First brush 30 and second brush 32 may rotate at the same rate or, alternatively, one brush may rotate at a different rate than the other brush. In some examples, first brush 30 is configured to rotate at a faster speed than second brush 32. Rotating first brush 30 at a faster speed than second brush 32 may configure the first brush to provide a high-speed scrubbing action while rotating second brush at a comparatively slower speed may allow the brush to help dry the surface being cleaned and effectively discharge debris into solid debris collection reservoir 34. As examples, first brush 30 may rotate at a speed greater than approximately 800 revolutions per minute, such as a speed ranging from 800 rpm to 1200 rpm, while second brush 32 may rotate at a speed less than 800 revolutions per minute, such as a speed from approximately 500 rpm to 800 rpm.

Figure 6:
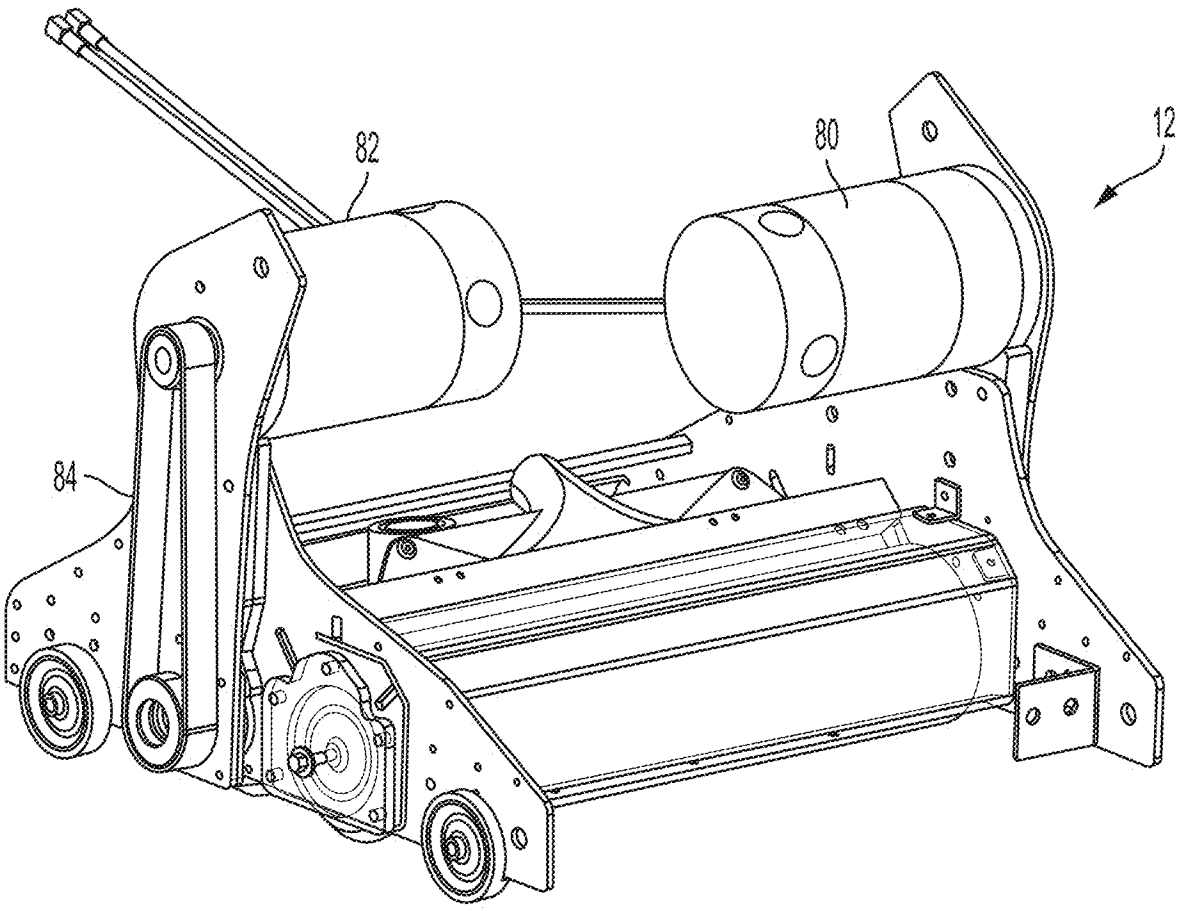
FIG. 6 is an illustration of an example motor arrangement that can be used on the sweeper/scrubber assembly of FIGS. 2, 3, and 8.

Sweeper/scrubber assembly 12 can have a variety of different motor positions and configurations to drive one or more brushes on the assembly. As one example, each driven brush may have a motor positioned within the core of the brush that drives rotation of the external bristles on the brush. As another example, one or more motors may be positioned external to each driven brush and connected to the brush via a belt, gearing, or other force transfer mechanism. FIG. 3 illustrates first and second motors 80, 82 positioned concentric with and inside of the first and second brushes 30, 32, respectively. FIG. 6 is an illustration of an alternative example arrangement of sweeper/scrubber assembly 12 having a motor positioned external to the driven brushes and connected thereto. In particular, FIG. 6 illustrates first and second motors 80, 82 positioned outside of first and second brushes 30, 32, respectively, and mechanically coupled thereto via belts 84.

The size and type of each brush used in sweeper/scrubber assembly 12 may vary depending on the desired application. In the illustrated configuration of FIGS. 2 and 3, first brush 30 and second brush 32 are shown as having a substantially same diameter. By contrast, third brush 40 is illustrated as having a smaller diameter, such as a diameter that is one half or less that of the first and second brushes.

Each brush within sweeper/scrubber assembly 12 may be made of the same material, or at least one brush may be made of a different material that at least one other brush. Any suitable natural and/or synthetic fibers may be used for the brushes in the assembly. Typical brushes may be cylindrical in shape and have bristle tufts secured about the perimeter of thereof. The density and diameter of the tufts may be varied to control the aggressiveness of the sweeping and scrubbing action provided by the brush, with larger diameter tuffs and/or denser tufts used where more aggressive cleaning is desired.

In some examples, one or more the brushes used on sweeper/scrubber assembly 12 may be formed of a microfiber material (e.g., such that an outer most contact surface of the brush is of a microfiber material with the core of the brush typically being of a different, more rigid material). Microfiber material is typically characterized as being a synthetic fiber having a small diameter, such as less than 1.5 denier, or less than 1 denier. The microfibers may be made from two relatively incompatible polymer materials, for example, polyester and polyamide. The fibers can be coextruded and then split into microfilaments during manufacturing. A typical microfiber brush structure includes a core structure with wedge shaped perimeter structures having a small (e.g., less than 0.5 denier aspect). The yarn made from the microfiber can contain high surface area wedge shaped filaments and a core filament. The capillary effect between the wedge shaped filament and the core filament can provide very high absorbency which, in turn, permits the microfiber structures to absorb large amounts of debris for effective cleaning. When used, the microfiber material on the brush may have a thickness (also referred to as pile height) ranging from 1 mm to 25 mm, such as from 10 mm to 20 mm. When exposed to a compressive force, the microfiber material may compress down to a thickness less than 80% of its uncompressed thickness.

As briefly discussed above with respect to FIG. 1, sweeper/scrubber assembly 12 may be mounted on chassis 18 and translatable on wheels 16. A variety of different wheel-type structures can be used on floor maintenance device 10 to impart the desired degree of mobility and rotational freedom for sweeper/scrubber assembly 12. Example wheel-type structures that can be used for floor maintenance device 10 include one or more caster wheels, roller balls, and/or omniwheels. Structures such as roller balls, omniwheels, and the like can allow floor maintenance device 10 in sweeper/scrubber assembly 12 attached thereto to translate in multiple dimensions, e.g., by allowing the floor contacting surface to translate in any desired direction without constraints.

In FIG. 1, floor maintenance device 10 is illustrated as a standup, walk behind system to which sweeper/scrubber assembly 12 is mounted. A sweeper/scrubber assembly as described herein may be used on any desired type of mobile platform, each of which has a different chassis configuration. FIGS. 7A-7C illustrate three example mobile platforms on which a sweeper/scrubber assembly according to disclosure may be mounted and used. FIG. 7A illustrates an upright system consistent with that shown in FIG. 1. FIG. 7B illustrates a walk behind system, which includes a platform that an operator stands on along with controls to steer the system. FIG. 7C illustrates a ride-on platform that includes a seat and controls for an operator to drive the system. Alternative floor maintenance driving platforms may be used with a sweeper/scrubber assembly according to the disclosure, such as a chariot or stand-on rider, as will be appreciated by those of ordinary skill in the art. While the illustrated examples of floor maintenance devices incorporating sweeper/scrubber assembly 12 show the devices as being configured to be driven by an operator (e.g., steered, propulsion controlled), a sweeper/scrubber assembly according to the disclosure may be implemented on a robotic or autonomously controlled device without departing from the scope of the disclosure.

While the foregoing discussion of sweeper/scrubber assembly 12 in connection with FIGS. 2 and 3 generally described the sweeper/scrubber assembly as being configured with first brush 30 and second brush 32 (along with optional knockdown brush 40), the sweeper/scrubber assembly can include fewer or more brushes. FIG. 8 is a side sectional view of sweeper/scrubber assembly 12 showing an alternative configuration of the assembly utilizing a single brush 30. Like reference numerals in FIG. 8 refer to like components discussed above.

For example, sweeper/scrubber assembly 12 in FIG. 8 is illustrated as including an optional housing 60 containing a single brush 30, a vacuum squeegee 52, and a solid debris collection reservoir 34. A cleaning fluid dispensing orifice 44 is illustrated as being positioned outside of housing 60 to dispense cleaning forward on a floor surface to be cleaned in advance of housing 60. In other implementations, as discussed above, cleaning fluid dispensing orifice 44 may be positioned inside of housing 60 (e.g., to dispense cleaning fluid on brush 30) or sweeper/scrubber assembly 12 may not include a cleaning fluid dispensing orifice.

Housing 60 in FIG. 8 is may include a front wall 70 that extends downwardly toward the floor surface being cleaned. In some configurations, front wall 70 or a portion thereof is angled rearwardly forward of brush 30. This rearward projection of front wall 70 can help isolate brush 30 inside of housing 60 (e.g., from an optional second brush 40 positioned outside of the housing to prevent airflow generated by the rotation of brush 30 from pushing debris out of the cleaning path of the assembly). In this regard, although sweeper/scrubber assembly 12 in FIG. 8 does not illustrate include a knockdown brush 40 either inside housing 60 or in front of the housing, the assembly may be implemented with such an additional knockdown brush 40, as discussed above.

To help remove excess moisture from the floor surface being cleaned, sweeper/scrubber assembly 12 includes vacuum squeegee 52. Vacuum squeegee 52 can define a vacuum orifice positioned adjacent to brush 30 of sweeper/scrubber assembly 12 that is in communication with vacuum 24 (FIG. 1) via a vacuum line. Vacuum squeegee 52 may be positioned against an outer surface of the brush from which the squeegee is intended to draw off moisture.

In FIG. 8, vacuum squeegee 52 is illustrated as extending under debris collection reservoir 34 rather than through a middle region of the reservoir. For example, bottom wall 46 of debris collection reservoir 34 may be defined by a top surface of the throat of vacuum squeegee 52. This arrangement can help offset vacuum squeegee 52 from the debris collection reservoir 34, increasing the open area for debris to be thrown from brush 30 into the debris collection reservoir without interfering or contacting with the vacuum squeegee occupying a portion of the debris collection reservoir. While FIG. 8 illustrates debris collection reservoir 34 and vacuum squeegee 52 as being an integrated, unitary component, the features may be seperable (e.g., with the debris collection reservoir being configured to slide out without removing vacuum squeegee 52) without departing from the scope of the disclosure.

Figure 9A:
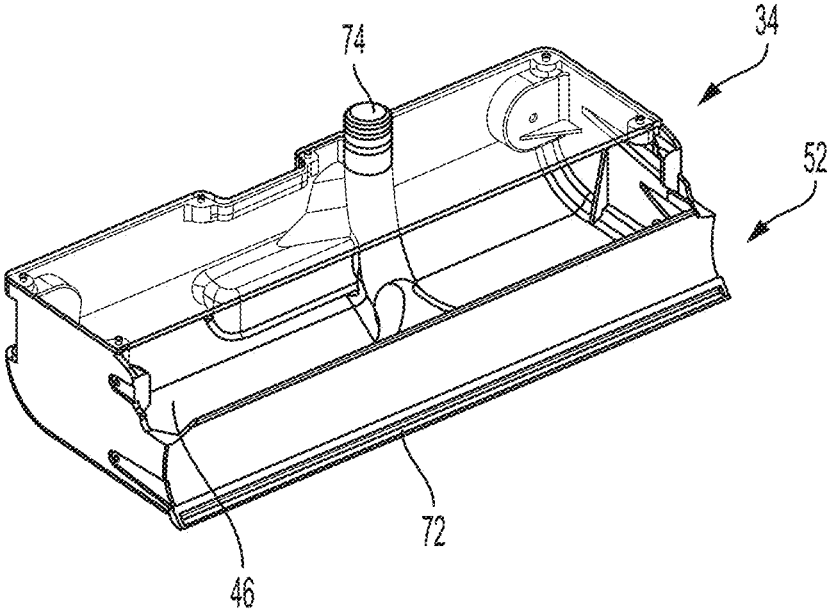
FIG. 9A is a perspective illustration of another example debris collection reservoir and vacuum squeegee that may be used on a sweeper/scrubber assembly according to the disclosure.
Figure 9B:
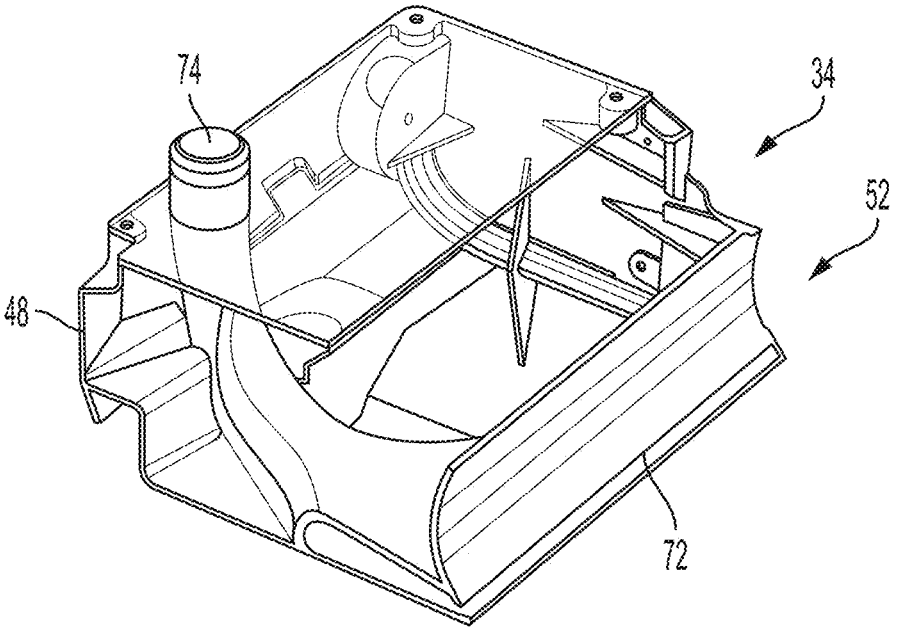
FIG. 9B is a side cutaway of the example debris collection reservoir and vacuum squeegee of FIG. 9A.

FIG. 9A is a perspective illustration of another example debris collection reservoir 34 and vacuum squeegee 52 that may be used on a sweeper/scrubber assembly according to the disclosure. FIG. 9B is a side cutaway of the example debris collection reservoir 34 and vacuum squeegee 52 of FIG. 9A. In the illustrated example, vacuum squeegee 52 is integrated with debris collection reservoir 34 to provide a unitary structure (e.g., such that the vacuum squeegee cannot be separated from the debris collection reservoir without disassembling or damaging the structure). Vacuum squeegee 52 defines a throat extending from a leading end 72 that is positionable against a brush to a trailing end 74 connectable to a vacuum hose. The vacuum orifice defined by vacuum squeegee 52 may narrow in cross-sectional height but expand out in length moving from the trailing end 74 to the leading end 72.

In the example of FIGS. 9A and 9B, a top surface of vacuum squeegee 52 between leading end 72 and trailing end 74 defines the bottom wall 46 of debris collection reservoir 34. When so configured, liquid drawn off of a brush in contact with vacuum squeegee 52 can flow under debris collection reservoir 34 and any solid debris contained therein. Trailing end 74 of vacuum squeegee 52 is illustrated as being positioned forward of and integrated with the rear wall 48 of debris collection reservoir 34 although, in other configurations, may be positioned rearward of the rear wall and/or not integrated with the rear wall.

Various examples have been described. These and other examples are within the scope of the following claims.

The invention claimed is:

1. A sweeper/scrubber assembly for cleaning a floor surface comprising:

a brush configured to rotate along the floor surface;

a cleaning fluid dispensing system configured to dispense cleaning fluid on at least one of the floor surface and the brush;

a vacuum squeegee positioned against the brush, the vacuum squeegee being configured to apply a vacuum suction force to a face of the brush, wherein the vacuum squeegee defines an orifice extending parallel to a length of the face of the brush, and the orifice is fluidly connected to a vacuum source; and a solid debris collection reservoir positioned rearwardly of the brush that is an unvacuumed space configured to receive solid debris thrown rearwardly by the brush, wherein the solid debris collection reservoir comprises a bottom wall, rear wall, and a front wall, and the front wall of the solid debris collection reservoir defines the orifice of the vacuum squeegee.

2. The assembly of claim 1, wherein the cleaning fluid dispensing system is configured to dispense cleaning fluid on the brush.

3. The assembly of claim 1, wherein: the brush comprises a first brush and a second brush, the first brush is configured to rotate along the floor surface about a first rotational axis; and the second brush is positioned adjacent to the first brush and is configured to rotate along the floor surface about a second rotational axis; the cleaning fluid dispensing system is configured to dispense cleaning fluid on at least one of the floor surface, the first brush, and the second brush; the vacuum squeegee is positioned against one of the first brush and the second brush, the vacuum squeegee being configured to apply a vacuum suction force to the face of the first brush or the second brush against which the vacuum squeegee is positioned; and the solid debris collection reservoir is configured to receive solid debris thrown by one or both of the first brush and the second brush.

4. The assembly of claim 3, wherein the vacuum squeegee is positioned against the second brush.

5. The assembly of claim 3, wherein the second brush is configured to rotate in a counter-rotational direction to the first brush.

6. The assembly of claim 3, wherein:

the second brush is positioned rearwardly of the first brush in a direction of forward movement for the assembly, the first brush is configured to rotate in a direction that moves solid debris on the floor surface rearwardly toward the second brush, and the solid debris collection reservoir is configured to receive solid debris swept under the first brush, then swept between the first and second brushes, followed by being swept over the second brush.

7. The assembly of claim 3, further comprising a third brush positioned forwardly of the first brush and the second brush.

8. The assembly of claim 7, wherein the third brush is configured to rotate at a slower rate than the first brush and the second brush.

9. The assembly of claim 7, wherein the first brush and the second brush are each driven by one or more motors, and the third brush is an idler brush not driven by a motor.

10. The assembly of claim 1, further comprising a housing containing the brush, the cleaning fluid dispensing system, the vacuum squeegee, and the solid debris collection reservoir.

11. The assembly of claim 10, wherein at least one of the solid debris collection reservoir and the vacuum squeegee is removable from the housing.

12. The assembly of claim 10, wherein the brush comprises a first brush and a second brush, the housing comprises a top surface with a downward step between the first brush and the second brush, thereby defining a first brush housing pocket containing the first brush and a second brush housing pocket containing the second brush between the downward step.

13. The assembly of claim 1, wherein the assembly is mounted to a mobile support having a powered drive for advancing the mobile support over the floor surface.

14. The assembly of claim 13, wherein the mobile support carries a cleaning fluid reservoir fluidly connected to the cleaning fluid dispensing system and a waste liquid reservoir fluidly connected to the vacuum squeegee.

15. The assembly of claim 1, wherein the vacuum squeegee comprises a throat extending from a leading end defining the orifice to a trailing end connectable to a vacuum hose.

16. The assembly of claim 15, wherein the vacuum squeegee narrows in cross-sectional height and expands in length from the trailing end to the leading end.

17. The assembly of claim 15, wherein the trailing end of the vacuum squeegee extends through the debris collection reservoir.

18. The assembly of claim 17, wherein the rear wall of the solid debris collection reservoir includes an aperture through which the vacuum hose is configured to extend to connect to the trailing end of the vacuum squeegee in the solid debris collection reservoir.

19. The assembly of claim 17, wherein the vacuum squeegee includes a bend that angles the trailing end upwardly for connection to the vacuum hose.

20. A mobile floor cleaner comprising:

a mobile support having a powered drive for advancing the mobile support over a floor surface to be cleaned, a sweeper/scrubber assembly carried by the mobile support, the sweeper/scrubber assembly comprising:

a first brush being configured to rotate along the floor surface about a first rotational axis;

a second brush being positioned adjacent to and rearwardly of the first brush and being configured to rotate along the floor surface about a second rotational axis;

a cleaning fluid dispensing system configured to dispense cleaning fluid on at least one of the floor surface, the first brush, and the second brush;

a vacuum squeegee positioned against the second brush, the vacuum squeegee being configured to apply a vacuum suction force to a face of the second brush, wherein the vacuum squeegee defines an orifice extending parallel to a length of the face of the second brush, and the orifice is fluidly connected to a vacuum source;

a solid debris collection reservoir that is an unvacuumed space configured to receive solid debris thrown rearwardly by one or both of the first brush and the second brush, wherein the solid debris collection reservoir comprises a bottom wall, rear wall, and a front wall, and the front wall of the solid debris collection reservoir defines the orifice of the vacuum squeegee.

* * * * *